US010972832B1

(12) United States Patent
Pao

(10) Patent No.: US 10,972,832 B1
(45) Date of Patent: Apr. 6, 2021

(54) SOUNDING BODY

(71) Applicant: Chih-Chi Chen, Taipei (TW)

(72) Inventor: Yun-Hui Pao, Taipei (TW)

(73) Assignee: Chih-Chi Chen, Taipei (TW)

( * ) Notice: Subject to any disclaimer, the term of this patent is extended or adjusted under 35 U.S.C. 154(b) by 0 days.

(21) Appl. No.: 16/813,143

(22) Filed: Mar. 9, 2020

(51) Int. Cl.
*H04R 1/28* (2006.01)
*H04R 1/02* (2006.01)

(52) U.S. Cl.
CPC ..... *H04R 1/288* (2013.01); *H04R 1/025* (2013.01)

(58) Field of Classification Search
CPC ..... H04R 1/288; H04R 1/025
USPC ..... 381/354
See application file for complete search history.

(56) References Cited

U.S. PATENT DOCUMENTS 7,460,679 B2 * 12/2008 Itoh ..... H04R 1/021 381/182
2006/0215865 A1 * 9/2006 Kang ..... H04R 1/288 381/333
2008/0095394 A1 * 4/2008 Yoon ..... H01Q 1/38 381/386
2009/0220116 A1 * 9/2009 Ryou ..... H01Q 1/44 381/354
2012/0183170 A1 * 7/2012 Chen ..... H04R 1/02 381/386
2013/0223655 A1 * 8/2013 Lee ..... H04R 1/2811 381/189
2020/0213695 A1 * 7/2020 Feng ..... H04R 31/006

* cited by examiner

*Primary Examiner* — Sean H Nguyen
(74) *Attorney, Agent, or Firm* — Alan D. Kamrath; Karin L. Williams; Mayer & Williams PC

(57) ABSTRACT

A sounding body contains: an accommodation chamber and at least one locking tab. A respective one of the at least one locking tab includes a fixing groove. The sounding body further contains a speaker unit which includes a fitting member having a cavity, and the cavity is engaged with a speaker. A first support loop is fitted on the fitting member and has multiple first extension portions, and each of the multiple first extension portions has a first positioning knob. The fitting member is fitted with a second support loop on which multiple second extension portions obliquely extend, and each of the multiple second extension portions has a second positioning knob engaged with the fixing groove of the respective one locking tab. Furthermore, a shock-absorbing space is defined between the speaker unit and the accommodation chamber.

3 Claims, 5 Drawing Sheets

SOUNDING BODY

BACKGROUND OF THE INVENTION

Field of the Invention

The present invention relates to a sounding body which contains a shock-absorbing space formed in the sounding body so that sounds from a speaker produce resonance.

Description of the Prior Art

Referring to FIG. 1, a conventional Bluetooth speaker 10 is compact and portable, so reducing a size of the conventional Bluetooth speaker 10 (for example, resonance space of a speaker 20 is diminished) is inevitable. However, when the speaker 20 is accommodated in the conventional Bluetooth speaker 10, sounds from the speaker 20 cannot resonate, thus having poor sound quality.

Users have to stand poor sound quality after they purchase the conventional Bluetooth speaker 10 even though the conventional Bluetooth speaker 10 is portable easily, thereby reducing purchase desire.

The present invention has arisen to mitigate and/or obviate the afore-described disadvantages.

SUMMARY OF THE INVENTION

The primary objective of the present invention is to provide a sounding body which contains a first positioning knob and a second positioning knob engaged with a fixing groove of a respective one of multiple locking tabs so that each of multiple first and second extension portions supports a speaker unit, and a shock-absorbing space is defined between the speaker unit and an accommodation chamber, such that the shock-absorbing space produces a sound cabin to enhance sound effect, sound quality, and sound absorption.

To achieve above-mentioned objective, a sounding body provided by the present invention contains: an accommodation chamber formed in a sounding body and at least one locking tab arranged around a peripheral side of the accommodation chamber, and a respective one of the at least one locking tab including a fixing groove. The sounding body further contains a speaker unit accommodated in the accommodation chamber, the speaker unit includes a fitting member having a cavity passing through the fitting member longitudinally, and the cavity is engaged with a speaker. A first support loop is fitted on a lower end of an outer wall of the fitting member and has multiple first extension portions extending outward from an outer wall of the first support loop, and each of the multiple first extension portions has a first positioning knob formed on a distal end of each first extension portion and engaged with the fixing groove of the respective one locking tab, the outer wall of the fitting member is fitted with a second support loop on which multiple second extension portions obliquely extend outward from an outer wall of the second support loop, and each of the multiple second extension portions has a second positioning knob formed on a distal end of each second extension portion and engaged with the fixing groove of the respective one locking tab. The first positioning knob and the second positioning knob are engaged with the fixing groove of the respective one locking tab so that each first extension portion and each second extension portion support the speaker unit, and a shock-absorbing space is defined between the speaker unit and the accommodation chamber.

Preferably, the fitting member also has multiple through orifices defined around the outer wall thereof and passing through the cavity, and a first sound damping membrane is arranged on the outer wall of the fitting member, wherein the first sound damping membrane covers the multiple through orifices.

Preferably, the fitting member further has a first connection ring extending around the lower end of an outer wall of the fitting member, and a second connection ring extending around an upper end of the outer wall of the fitting member. The first support loop is mounted on the first connection ring, and the first sound damping membrane is defined among the first support loop, the fitting member, and the first connection ring. The second support loop is secured below the second connection ring, and the first sound damping membrane is defined among the second support loop, the fitting member, and the second connection ring. In addition, a second sound damping membrane is adhered on a lower end of the first connection ring so as to close the cavity.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
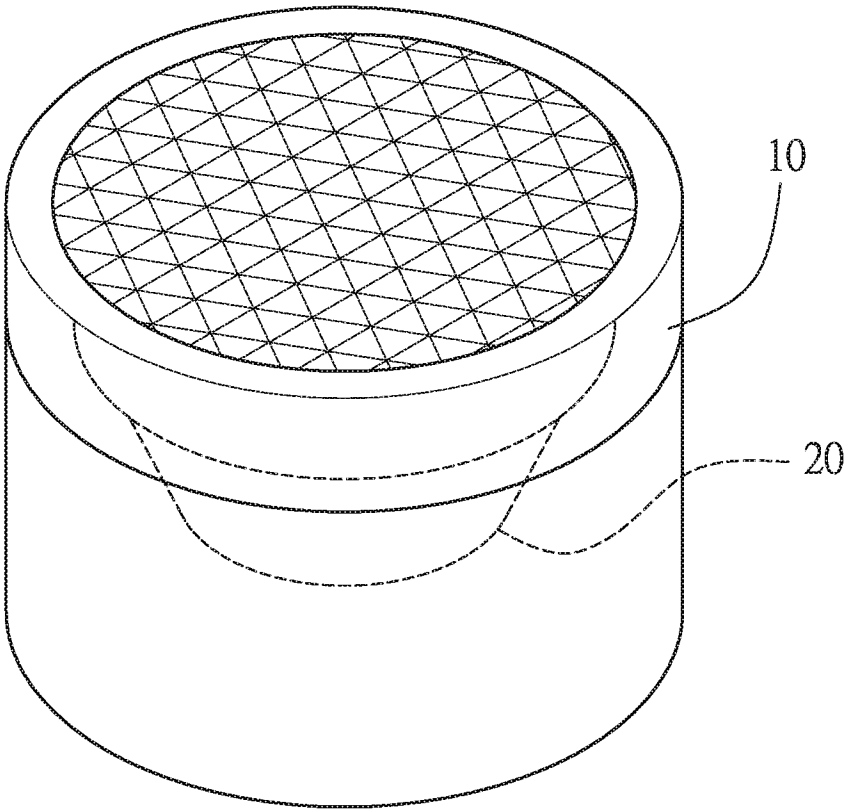
FIG. 1 PRIOR ART
FIG. 1 is a perspective view of a conventional Bluetooth speaker.
Figure 2:
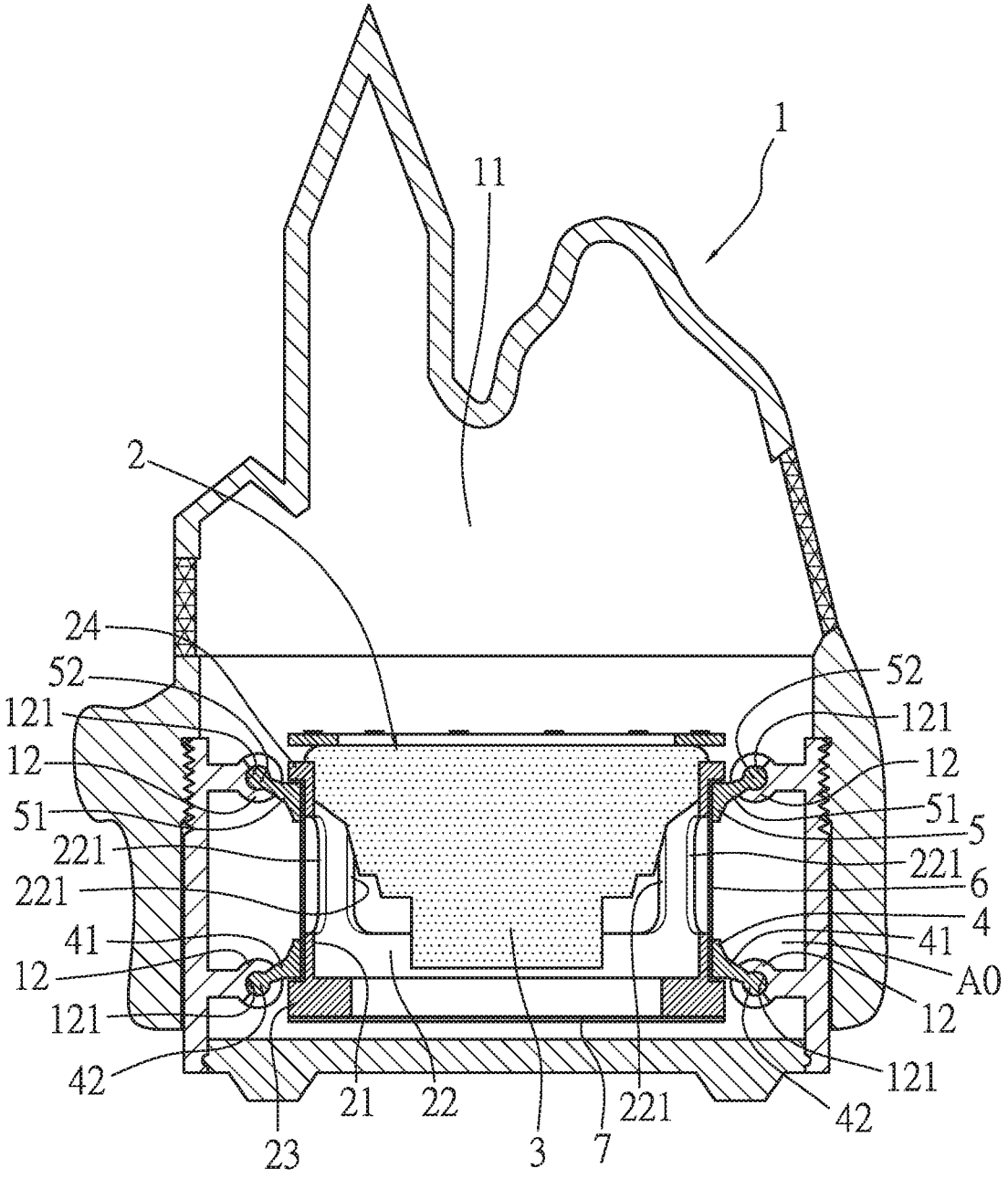
FIG. 2 is a cross sectional view showing the assembly of a sounding body according to a preferred embodiment of the present invention.
Figure 3:
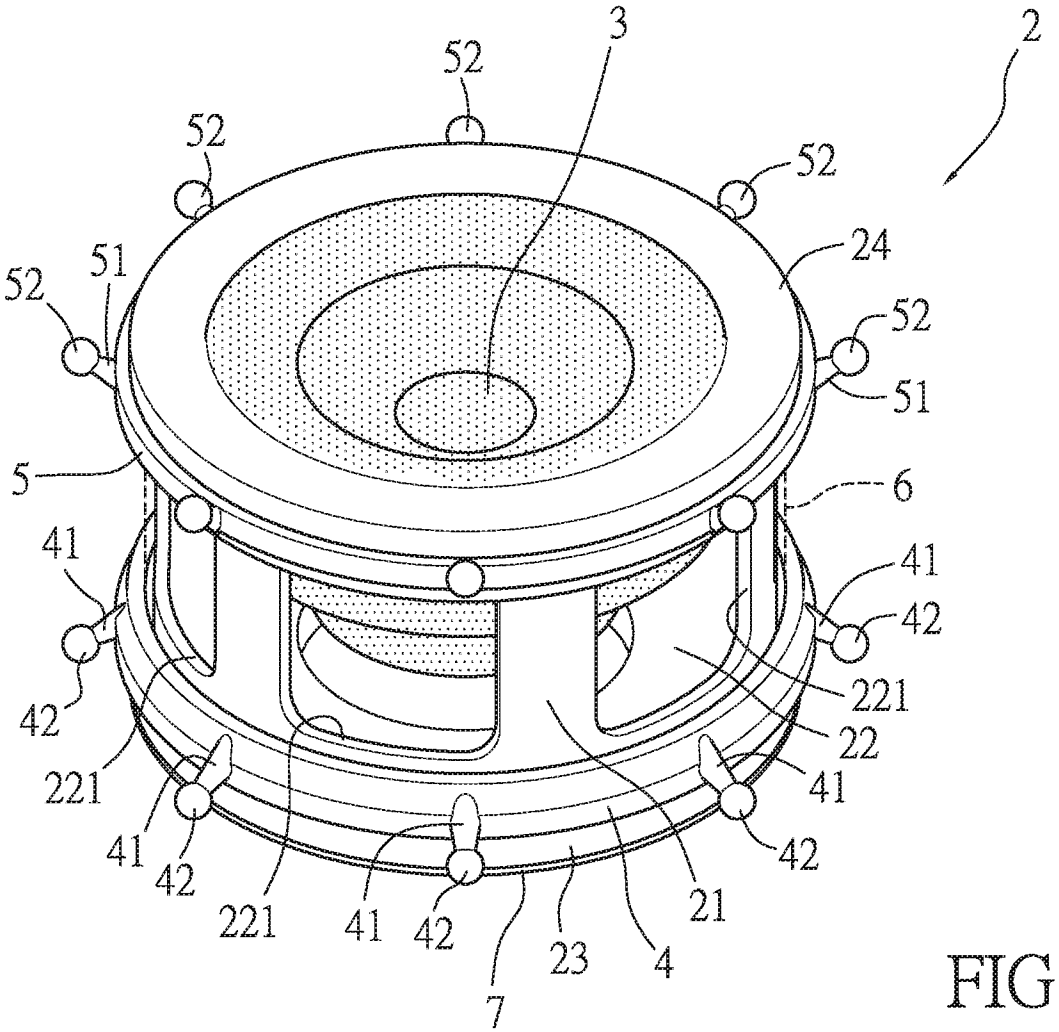
FIG. 3 is a perspective view showing the assembly of a speaker unit of the sounding body according to the preferred embodiment of the present invention.

With reference to FIGS. 2 and 3, a sounding body 1 according to a preferred embodiment of the present invention comprises an accommodation chamber 11 formed in the sounding body 1 and at least one locking tab 12 arranged around a peripheral side of the accommodation chamber 11, a respective one of the at least one locking tab 12 including a fixing groove 121, and the sounding body 1 further comprising a speaker unit 2 accommodated in the accommodation chamber 11, the speaker unit 2 including a fitting member 21 having a cavity 22 passing through the fitting member 21 longitudinally, and the cavity 22 engaged with a speaker 3; a first support loop 4 fitted on a lower end of an outer wall of the fitting member 21 and having multiple first extension portions 41 extending outward from an outer wall of the first support loop 4, and each of the multiple first extension portions 41 having a first positioning knob 42 formed on a distal end of each first extension portion 41 and engaged with the fixing groove 121 of the respective one locking tab 12, the outer wall of the fitting member 21 being fitted with a second support loop 5 on which multiple second extension portions 51 obliquely extend outward from an outer wall of the second support loop 5, and each of the multiple second extension portions 51 having a second positioning knob 52 formed on a distal end of each second extension portion 51 and engaged with the fixing groove 121 of the respective one locking tab 12; wherein the first positioning knob 42 and the second positioning knob 52 are engaged with the fixing groove 121 of the respective one locking tab 12 so that each first extension portion 41 and each second extension portion 51 support the speaker unit 2, and a shock-absorbing space AO is defined between the speaker unit 2 and the accommodation chamber 11.

Referring to FIGS. 2 and 3, the fitting member 21 also has multiple through orifices 221 defined around the outer wall thereof and passing through the cavity 22, and a first sound damping membrane 6 is arranged on the outer wall of the fitting member 21, wherein the first sound damping membrane 6 covers the multiple through orifices 221. The fitting member 21 further has a first connection ring 23 extending around the lower end of an outer wall of the fitting member 21, and a second connection ring 24 extending around an upper end of the outer wall of the fitting member 21; wherein the first support loop 4 is mounted on the first connection ring 23, and the first sound damping membrane 6 is defined among the first support loop 4, the fitting member 21, and the first connection ring 23; the second support loop 5 is secured below the second connection ring 24, and the first sound damping membrane 6 is defined among the second support loop 5, the fitting member 21, and the second connection ring 24, wherein a second sound damping membrane 7 is adhered on a lower end of the first connection ring 23 so as to close the cavity 22.

Figure 4:
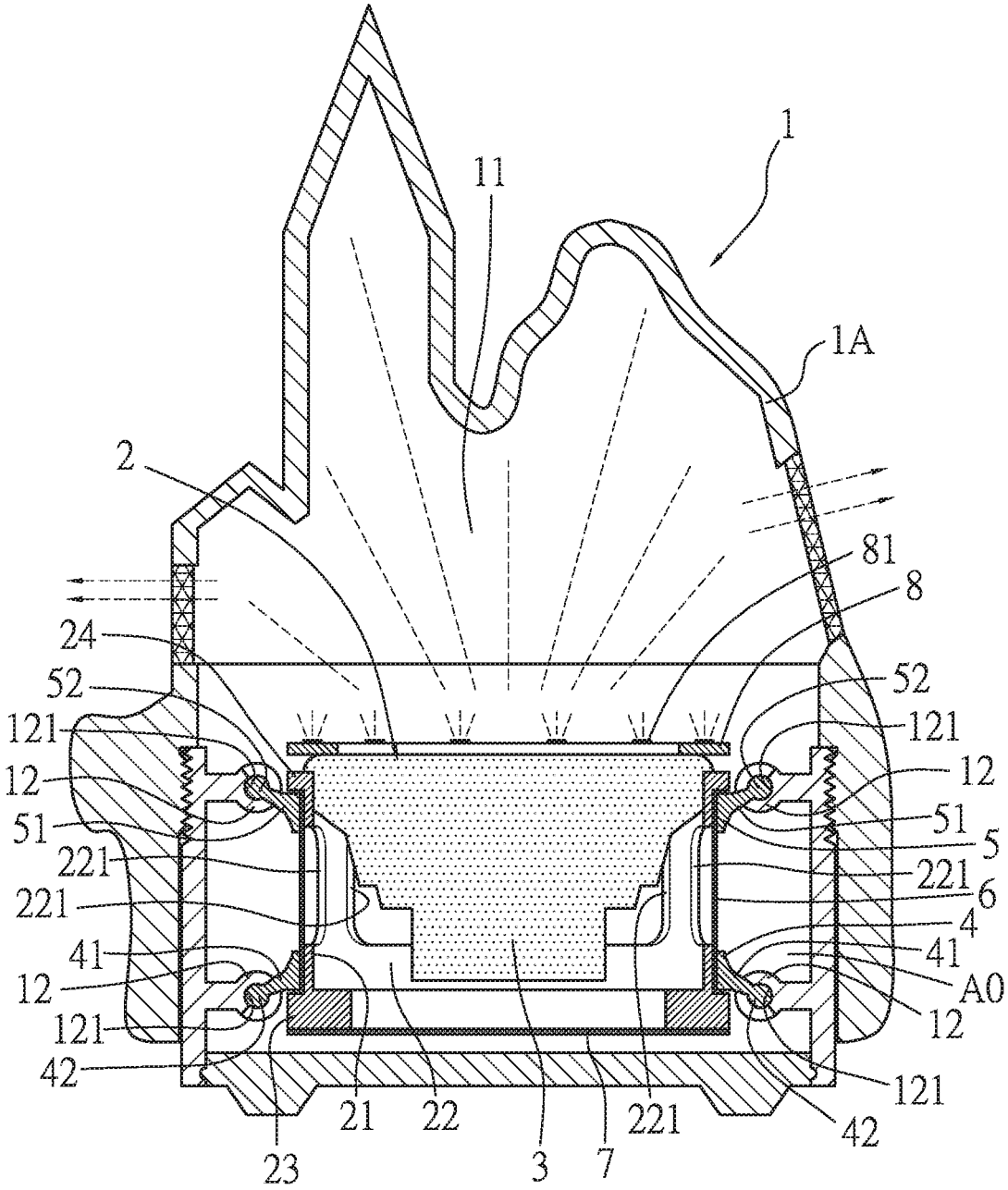
FIG. 4 is a cross sectional view showing the operation of the sounding body according to the preferred embodiment of the present invention.
Figure 5:
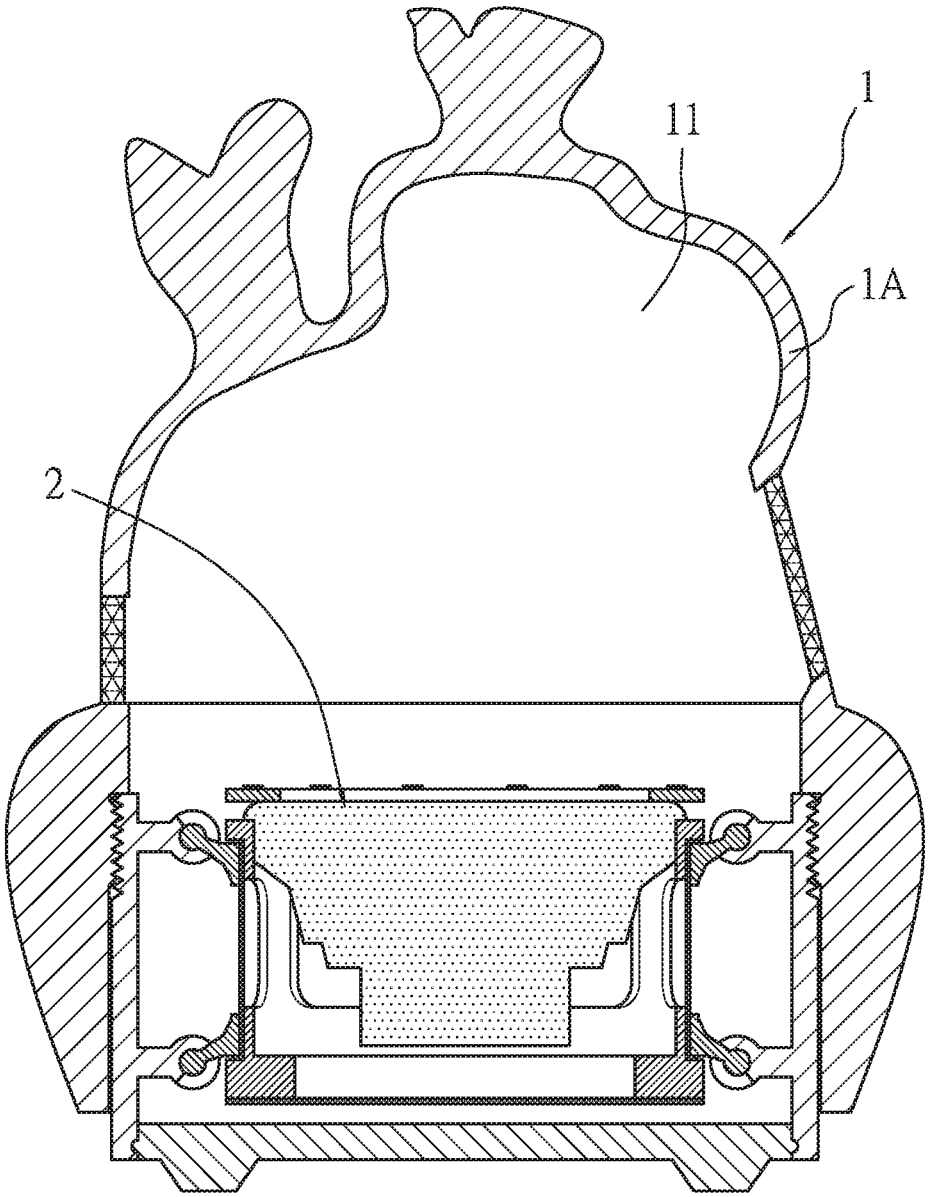
FIG. 5 is another cross sectional view showing the operation of the sounding body according to the preferred embodiment of the present invention.

Thereby, sounds from the speaker 3 are absorbed by using the cavity 22, the multiple through orifices 221, the first sound damping membrane 6, and the second sound damping membrane 7, wherein the first sound damping membrane 6 and the second sound damping membrane 7 are made of silicone film. Preferably, the speaker 3 is accommodated in the accommodation chamber 11 of the sounding body 1 to integrate with aerodynamic energy from the sounds, thus balancing resonant performance and quality of the sounds in the cavity 22 like a sound cabin. In addition, the first positioning knob 42 of each first extension portion 41 and the second positioning knob 52 of each second extension portion 51 are engaged with the fixing groove 121 so that each first extension portion 41 and each second extension portion 51 support the speaker unit 2 in the accommodation chamber 11, and the shock-absorbing space AO between the speaker unit 2 and the accommodation chamber 11 is expanded to amplify the sounds of small wattage from the speaker 3 and to enhance sound effect (such as no noises make) of the speaker 3. The accommodation chamber 11 further accommodates a circuit board ring 8 on which multiple light-emitting diodes (LEDs) 81 are arranged so as to emit bright lights to enhance visual effect by mating with the sounds from the speaker 3. Preferably, the cavity 22 is closed like the sound cabin to enhance sound effect, sound quality, and sound absorption, as illustrated in FIG. 4. A decoration cap 1A is connected on the sounding body 1 (i.e., the decoration cap 1A is fitted on a top of the accommodation chamber 11) so as to enhance aesthetics appearance based on using requirements and market competitiveness, as shown in FIGS. 4 and 5.

The sounds from the speaker 3 are shocked by ways of the cavity 22, the multiple through orifices 221, the first sound damping membrane 6, and the second sound damping membrane 7 to optimize the sound effect so that the speaker 3 is applicable for the sounding body 1 of a small size to integrate the sounds and to balance the sound effect of the speaker 3 in the cavity 22. Preferably, the shock-absorbing space AO is expanded to absorb a shock of the sounds and to produce the sound cabin from the sounds of the speaker 3, such that the sounds of the small wattage of the speaker 3 are amplified like sound of large wattage.

While various embodiments in accordance with the present invention have been shown and described, it is clear to those skilled in the art that further embodiments may be made without departing from the scope of the present invention.

What is claimed is:

1. A sounding body comprising:

an accommodation chamber formed in the sounding body and at least one locking tab arranged around a peripheral side of the accommodation chamber, a respective one of the at least one locking tab including a fixing groove, and the sounding body further comprising a speaker unit accommodated in the accommodation chamber, the speaker unit including a fitting member having a cavity passing through the fitting member longitudinally, and the cavity engaged with a speaker; a first support loop fitted on a lower end of an outer wall of the fitting member and having multiple first extension portions extending outward from an outer wall of the first support loop, and each of the multiple first extension portions having a first positioning knob formed on a distal end of each first extension portion and engaged with the fixing groove of the respective one locking tab, the outer wall of the fitting member being fitted with a second support loop on which multiple second extension portions obliquely extend outward from an outer wall of the second support loop, and each of the multiple second extension portions having a second positioning knob formed on a distal end of each second extension portion and engaged with the fixing groove of the respective one locking tab; wherein the first positioning knob and the second positioning knob are engaged with the fixing groove of the respective one locking tab so that each first extension portion and each second extension portion support the speaker unit, and a shock-absorbing space is defined between the speaker unit and the accommodation chamber.

2. The sounding body as claimed in claim 1, wherein the fitting member also has multiple through orifices defined around the outer wall thereof and passing through the cavity, and a first sound damping membrane is arranged on the outer wall of the fitting member, wherein the first sound damping membrane covers the multiple through orifices.

3. The sounding body as claimed in claim 2, wherein the fitting member further has a first connection ring extending around the lower end of an outer wall of the fitting member, and a second connection ring extending around an upper end of the outer wall of the fitting member; wherein the first support loop is mounted on the first connection ring, and the first sound damping membrane is defined among the first support loop, the fitting member, and the first connection ring; the second support loop is secured below the second connection ring, and the first sound damping membrane is defined among the second support loop, the fitting member, and the second connection ring, wherein a second sound damping membrane is adhered on a lower end of the first connection ring so as to close the cavity.

* * * * *